US005944289A

United States Patent [19]

Speece

[11] Patent Number: 5,944,289

[45] Date of Patent: Aug. 31, 1999

[54] ERGONOMIC WRIST REST FOR A COMPUTER MOUSE INPUT DEVICE

[76] Inventor: Conrad A. Speece, 10477 Silverock Dr., Dallas, Tex. 75218

[21] Appl. No.: 08/796,061

[22] Filed: Feb. 4, 1997

[51] Int. Cl.[6] ..... B43L 15/00

[52] U.S. Cl. ..... 248/118.5

[58] Field of Search ..... 248/118, 118.5, 248/118.1, 118.3; 128/879, 877

[56] References Cited

U.S. PATENT DOCUMENTS

| | | | |
|---|---|---|---|
| 188,984 | 3/1877 | Taylor | 248/118.5 X |
| 2,477,898 | 8/1949 | Rehman et al. | 248/118 |
| 2,766,463 | 10/1956 | Bendersky | 248/118 X |
| 4,259,949 | 4/1981 | Axelsson | 248/118 X |
| 4,862,904 | 9/1989 | West et al. | 128/877 |
| 4,941,480 | 7/1990 | McLean et al. | 128/879 X |
| 4,996,977 | 3/1991 | Tiedeken | 248/118 X |
| 5,193,771 | 3/1993 | Hassel et al. | 248/118 |
| 5,335,888 | 8/1994 | Thomsen | 248/118.1 X |

*Primary Examiner*—Ramon O. Ramirez
*Attorney, Agent, or Firm*—Locke Liddell & Sapp LLP

[57] ABSTRACT

An ergonomic wrist rest for a user of a computer mouse input device is adapted to be received by the arm of the user and extends to the user's wrist for maintaining the user's hand in a predetermined position with respect to the arm of the user when the fingers of the user contact the mouse input device.

1 Claim, 1 Drawing Sheet

ERGONOMIC WRIST REST FOR A COMPUTER MOUSE INPUT DEVICE

TECHNICAL FIELD OF THE INVENTION

The present invention relates to rests, and more particularly to an ergonomic wrist rest for a computer mouse input device.

BACKGROUND OF THE INVENTION

Carpal tunnel syndrome has been associated with the use of computer input devices. The cause of carpal tunnel syndrome is using the hands, especially in repetitive motion, with the hands deviated radially at the wrist or using the thenar deviation position which narrows the wrist, compressing the carpal tunnel between the distal ends of the radius and ulna. To avoid this problem, one should use the hands in an ergonomically correct position, which is lateral or ulnar deviation of the hand at the wrist, deviating the hand towards the small finger direction when using the hand.

Present computer input devices are not configured to maintain the wrist in an ergonomic position in order to prevent carpal tunnel syndrome. A need has thus arisen for an ergonomic wrist rest for a computer mouse to prevent improper wrist position and eliminate carpal tunnel syndrome.

SUMMARY OF THE INVENTION

In accordance with the present invention, an ergonomic wrist rest for a user of a computer mouse input device is provided. The wrist rest is adapted to be received by the arm of the user and extends to the user's wrist for maintaining the user's hand in a predetermined position with respect to the arm of the user when the fingers of the user contact the mouse input device.

BRIEF DESCRIPTION OF THE DRAWINGS

For a more complete understanding of the present invention and for further advantages thereof, reference is now made to the following Description of the Preferred Embodiments taken in conjunction with the accompanying Drawings illustrating the present invention.

DESCRIPTION OF THE PREFERRED EMBODIMENTS

Figure 1:
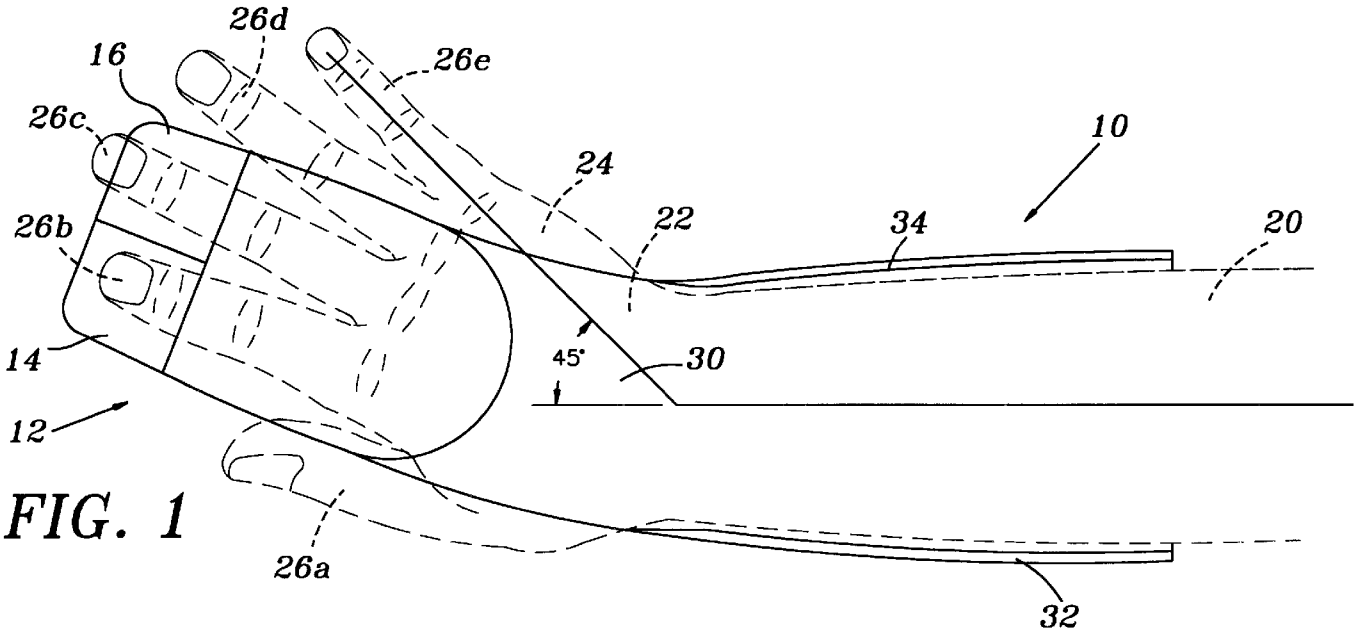
FIG. 1 is a top plan view of the present ergonomic wrist rest with a user's arm, hand, and fingers in phantom.
Figure 2:
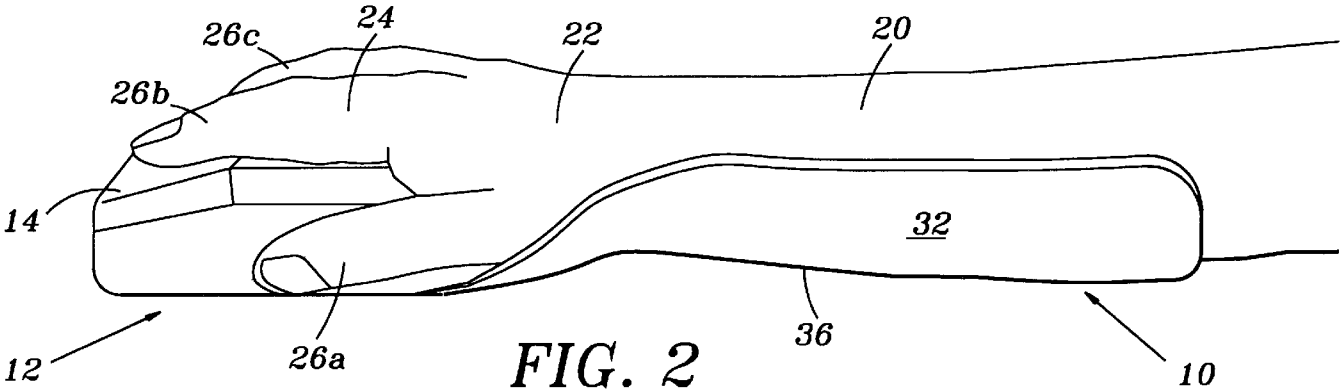
FIG. 2 is a side elevational view of the present ergonomic wrist rest.

Referring simultaneously to FIGS. 1 and 2, the present ergonomic wrist rest is illustrated, and is generally identified by the numeral 10. Wrist rest 10 is used in conjunction with a computer mouse input device, generally identified by the numeral 12. Mouse input device 12 is a conventional device for inputting data to a computer, and is actuated by keys 14 and 16.

FIGS. 1 and 2 illustrate a user's arm 20, wrist 22, hand 24, and fingers 26*a*–26*e*. Fingers 26*b* and 26*c* are positioned to actuate keys 14 and 16, respectively.

In accordance with the present invention, ergonomic wrist rest 10 maintains hand 24 in a predetermined angular position with respect to arm in order to position hand 24 at an angle of approximately 30° to 45° with respect to arm 20. This position is illustrated in FIG. 1 by angle 30, measured with respect to the center of arm 20 and finger 26*e*. This position is a desired position in order to prevent carpal tunnel syndrome.

Ergonomic wrist rest 10 is adapted to be received by arm 20 between side members 32 and 34 and has a U-shape cross section. Side members 32 and 34 are joined together via a base 36. Side members 32 and 34 extend to wrist 22, and are configured to restrain wrist 22 and thereby maintain hand 24 in a desired position. Fingers 26 extend from wrist rest 10 to allow a user to grasp mouse input device 12 and actuate keys 14 and 16. Side members 32 and 34 of 10 frictionally engage arm 20, and provide sufficient pressure on wrist 22 and hand 24 to orient hand 24 in the desired position, and illustrated in FIG. 1. Wrist rest 10 may be fabricated from a lightweight plastic material or metal, similar to that used for splints.

In use, wrist rest 10 is positioned around arm 20, with hand 24 extending therefrom in order to grasp mouse input device 12. The user can manipulate mouse input device 12 in a conventional manner for interaction with a computer with the user's hand position controlled by wrist rest 10, the user's hand slightly bent towards finger 26*e*.

Whereas the present invention has been described wit h respect to specific embodiments thereof, it will be understood that various changes and modifications will be suggested to one skilled in the art and it is intended to encompass such changes and modifications as fall within the scope of the appended claims.

I claim:

1. An ergonomic wrist rest for a user of a computer mouse input device, the user having an arm, wrist, hand, thumb, and fingers, the wrist rest comprising:

first and second rigid curvilinear sidewalls interconnected by a base, said sidewalls and base forming a channel having a first end and a second end, said channel first end adaptable to be disposed adjacent to the user's wrist and said channel adaptable for receiving the arm of the user between said sidewalls and between said first and second ends of said channel, said sidewalls extendable along a portion of the arm of the user to the user's wrist, said first sidewall adjacent said channel first end angularly disposed with respect to said second sidewall adjacent said channel first end and adjacent to the user's wrist and thumb for applying pressure to the user's hand, said first and second sidewalls disposed parallel to each other at said channel second end and are disposable parallel to the user's arm, to thereby position the user's hand in a predetermined angular position with respect to said side walls adjacent said channel first end and the arm of the user, the user's hand being angled and constrained toward the small finger of the user's hand when the fingers of the user contact the computer mouse input device.

* * * * *